United States Patent [19]

Bowman

[11] Patent Number: 4,461,126

[45] Date of Patent: Jul. 24, 1984

[54] CLEANING PROCESS FOR CORRUGATED ALUMINUM ELECTRICAL TRANSMISSION LINE ENCLOSURE

[75] Inventor: Gary K. Bowman, Westborough, Mass.

[73] Assignee: The United States of America as represented by the United States Department of Energy, Washington, D.C.

[21] Appl. No.: 363,756

[22] Filed: Mar. 30, 1982

[51] Int. Cl.[3] ..... B24B 1/00

[52] U.S. Cl. ..... 51/313; 51/317; 51/7; 51/19; 51/411; 51/164.1; 15/104.05

[58] Field of Search ..... 15/104.05; 51/313, 314, 51/315, 316, 317, 163.1, 164 R, 2 R, 7, 411, 19

[56] References Cited

U.S. PATENT DOCUMENTS

| | | | |
|---|---|---|---|
| 805,245 | 11/1905 | Thompson | 51/2 R |
| 1,706,877 | 3/1929 | Fabens | 51/2 R |
| 2,029,424 | 2/1936 | Hill | 51/2 R |
| 2,196,058 | 4/1940 | Coats | 51/163.1 |
| 2,299,032 | 10/1942 | Ransohoff | 51/164.1 |
| 2,395,593 | 2/1946 | Trager | 51/164.1 |

*Primary Examiner*—Harold D. Whitehead
*Attorney, Agent, or Firm*—M. S. Yatsko

[57] ABSTRACT

A process for preparing the interior of a corrugated pipe or sheath comprises the steps of placing a predetermined amount of a tumbling abrasive material into the sheath, and then rotating the sheath.

3 Claims, 3 Drawing Figures

CLEANING PROCESS FOR CORRUGATED ALUMINUM ELECTRICAL TRANSMISSION LINE ENCLOSURE

GOVERNMENT RIGHTS STATEMENT

The Government has rights in this invention pursuant to Contract No. DE-AC01-78-ET-29046 awarded by the United States Department of Energy.

BACKGROUND OF THE INVENTION

This invention relates generally to pipe cleaning processes, and more particularly to a process for cleaning and preparing the interior of a corrugated outer housing used in flexible compressed gas-insulated high-voltage transmission lines.

Compressed gas-insulated transmission lines are being increasingly utilized to transmit large magnitudes of electrical energy. Typical gas-insulated transmission lines include a cylindrical rigid outer sheath, or outer housing, typically at ground potential and a high voltage inner conductor disposed within the outer sheath. An insulating gas, such as sulfur hexafluoride, is utilized inside the outer sheath to electrically insulate the inner conductor from the outer sheath. Insulating spacers are utilized at spaced intervals along the length of the transmission line to insulatably support the inner conductor within the outer sheath.

One disadvantage with a typical gas-insulated transmission line is that the line itself is rigid; it cannot be significantly bent or turned to accommodate changes in direction or to avoid unforeseen obstacles within its path. All changes of direction in a transmission line must therefore typically be accomplished through the use of separate elements such as elbows or junction boxes. To overcome this drawback, a new type of gas-insulated transmission is to be investigated. The new type of gas-insulated transmission line utilizes a corrugated outer sheath and a flexible inner conductor to provide flexibility in the transmission line. This flexibility can then be utilized to facilitate changes of direction.

One obstacle which has been encountered in the development of such flexible gas-insulated transmission lines involves preparation of the interior surface of the corrugated aluminum enclosure. During the fabrication process and assembly of such outer corrugated enclosure, it is possible that burrs, sharp edges, and weld build-up or penetration can be present on the interior surface of the outer sheath; the presence of these abberations can enhance the electrical field during the operation of the gas-insulated transmission line, and thus cause substantial electric field problems. Furthermore, particles may be loosely adhered to the outer sheath which would subsequently become loose during operation of the transmission line and, upon becoming mobile, cause premature initiation of breakdown of the transmission line. Therefore, to avoid these problems, the interior surface of the corrugated outer sheath must be prepared and cleaned to remove these abberations.

The means utilized in the preparing and cleaning of the prior art smooth, rigid outer sheath involved the rotation of reamers with either serrated or wheel flappers. While these machines can be utilized on the smooth interior surfaces of the rigid pipe, they are inadequate for use with the corrugated outer sheath; the reamers would only contact the crowns of the corrugations, and not clean nor prepare any of the troughs of the corrugated pipe.

SUMMARY OF THE INVENTION

In accordance with this invention, a process for preparing the interior of a corrugated pipe or sheath comprises the steps of placing a predetermined amount of a tumbling abrasive material into the sheath, and then rotating the sheath.

BRIEF DESCRIPTION OF THE DRAWINGS

Reference is now made to the description of the preferred embodiment, illustrated in the accompanying drawings, in which.

DESCRIPTION OF THE PREFERRED EMBODIMENTS

Figure 1:
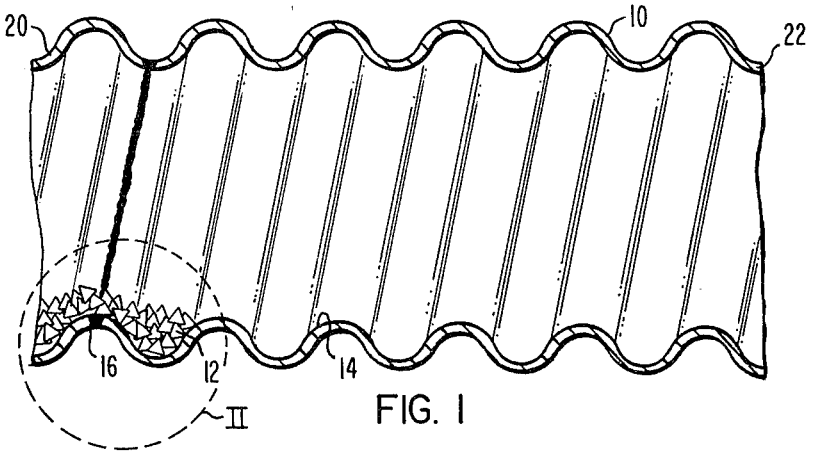
FIG. 1 is a view, partly in section and partly in elevation, of a spirally corrugated sheath having an abrasive material disposed therein practicing the process of this invention.

Referring now more particularly to FIG. 1, therein is illustrated a spirally corrugated pipe 10 which would be, for example, the outer housing of a compressed gas-insulated flexible high-voltage transmission line. The pipe 10 has disposed therein a predetermined amount of a tumbling abrasive material 12 which is used for cleaning and preparing the interior surface 14 of the sheath 10.

Figure 2:
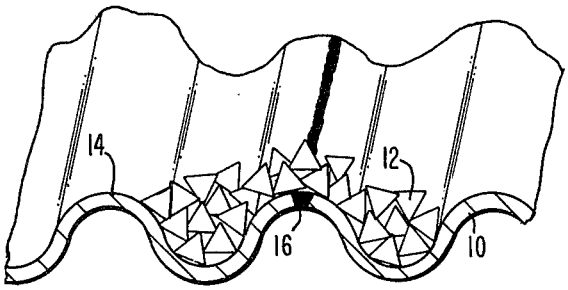
FIG. 2 is a view illustrating in greater detail the indicated circled portion of FIG. 1.

The tumbling abrasive material 12 can, for example, be the flat, triangularly-shaped ceramic abrasive material illustrated, although round or any other shape abrasive material can likewise be utilized. The triangularly-shaped ceramic abrasive, though, has a better cutting action which is preferable to reduce the protrusions which may result, for example, from the weld joint 16 (see also FIG. 2). The triangularly-shaped ceramic abrasives may be, for example, a size of 0.75 inch per side, although any suitable size may be utilized provided that the individual ceramic abrasive materials can fit down in the troughs 18 of the sheath 10. An amount of about 500–600 pounds of the ceramic abrasive 12 has been found to be a sufficient quantity to prepare the sheath 10.

To prepare the interior of the spirally corrugated sheath 10 illustrated in FIG. 1, a predetermined quantity of the abrasive material 12 is placed in one end 20 of the sheath 10, and the sheath 10 is then rotated, by means not shown, in the direction of the spiral corrugations.

The sheath 10 is rotated at a speed adjusted to obtain both a tumbling action and a sliding action of the abrasive material 12. This is preferable, as the sliding action provides both a grinding action and a sanding action on any high spots present within the interior 14 of the pipe 10 while the tumbling action provides a beating action. The speed of rotation can be adjusted to obtain which ever action—either tumbling or sliding, or both—which is most desirable. A turning speed which would obtain both a tumbling action and a sliding action of the abrasive material 12 is approximately 30 revolutions per minute of the sheath 10.

Because the sheath 10 illustrated in FIG. 1 is spirally corrugated, the abrasive material 12 need only be placed in position at one end 20 of the sheath. By rotating the sheath 10 in the direction of the spiral corrugations, the abrasive material 12 would be forced the length of the sheath 10 during rotation by the spiral configuration of the convolutions. In other words, the abrasive material 12 will tend to screw its way from one end 20 of the sheath 10 to the other end 22 of the sheath 10. In this manner, all of the interior surfaces 14 of the sheath 10 are cleaned and prepared. To obtain more intensive cleaning, once the abrasive material 12 has reached the end 22 of the sheath 10, the rotation of the sheath 10 can then be reversed, and the abrasive material 12 will then screw its way back to the original starting end 20. This reversal of direction of rotation of the sheath 10 can be repeated until the interior surface 14 of the sheath 10 is suitably processed.

Figure 3:
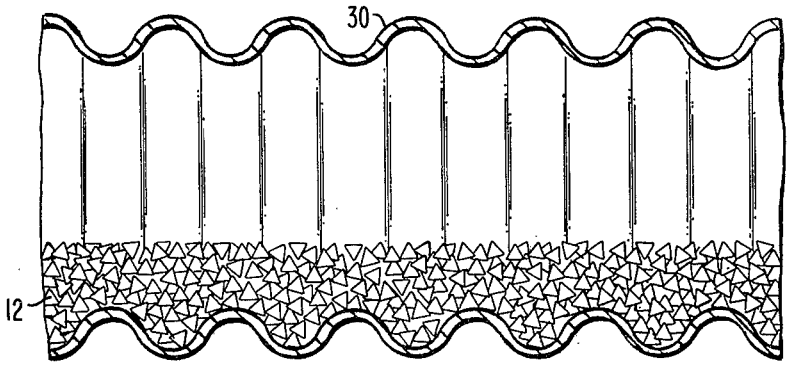
FIG. 3 is a modification of the view of FIG. 1 illustrating an annularly corrugated sheath.

Referring now to FIG. 3, it can be illustrated that the above-described cleaning process can also be used with an annularly corrugated sheath 30. With the use of an annularly corrugated sheath 30, the abrasive material 12 would have to be inserted into the sheath 30 along the entire length of the sheath 30. It would be preferable to fill the sheath 30 approximately one-quarter full. The sheath 30 is then rotated, with the abrasive material 12 leveling out and providing the cleaning and preparation process. As before, a desirable rotation speed of the sheath 30 would be approximately 30 revolutions per minute.

Therefore, it can be seen that the process of this invention provides a facilitated cleaning of the interior surface of a corrugated aluminum enclosure for use in the production of flexible gas-insulated transmission lines which can prepare both flat and corrugated areas and remove weld burrs and sharp edges which would cause enhanced field problems in operation of the transmission line.

I claim as my invention:

1. A process for preparing the interior of a spirally-corrugated sheath comprising the steps of:

placing a predetermined amount of a tumbling abrasive material in one end of said sheath;

rotating said sheath in the direction of said spiral corrugations until said tumbling abrasive material traverses from said one end of said sheath to the other end of said sheath; and then rotating said sheath in the reverse direction.

2. The process according to claim 4 wherein either rotating step comprises:

rotating said sheath at a speed so as to cause said tumbling abrasive material to both tumble and slide.

3. The process according to claim 4 wherein said placing step comprises:

placing a predetermined amount of a flat, triangularly-shaped ceramic abrasive into said sheath.

* * * * *